US007246463B1

(12) United States Patent
Arnot

(10) Patent No.: US 7,246,463 B1
(45) Date of Patent: Jul. 24, 2007

(54) CHRISTMAS TREE SUPPORT ASSEMBLY

(76) Inventor: Thomas M. Arnot, 4 Union St., Medford, NJ (US) 08055

( * ) Notice: Subject to any disclaimer, the term of this patent is extended or adjusted under 35 U.S.C. 154(b) by 0 days.

(21) Appl. No.: 11/250,775

(22) Filed: Oct. 17, 2005

(51) Int. Cl.
*A01G 17/10* (2006.01)

(52) U.S. Cl. ..... 47/42; 47/43; 248/124.1; 248/125.1

(58) Field of Classification Search ..... 248/124.1, 248/125.7, 125.8, 125.9, 176.1, 176.3, 188.5, 248/97, 98; 47/42, 43, 47
See application file for complete search history.

(56) References Cited

U.S. PATENT DOCUMENTS 2,677,518 A * 5/1954 Russell et al. ..... 248/125.7
3,985,924 A 10/1976 Pritza
4,111,471 A * 9/1978 Hanley ..... 289/16.5
4,968,541 A 11/1990 McCrory
5,161,768 A * 11/1992 Sarabin ..... 248/525
5,286,241 A * 2/1994 Petrakis ..... 482/87
5,439,196 A * 8/1995 Widman ..... 248/524
5,460,343 A * 10/1995 Hestilow ..... 248/124.1
5,486,386 A 1/1996 Rovsek
D391,706 S * 3/1998 Malcolm ..... D32/35
5,906,869 A 5/1999 Thomas
5,967,482 A 10/1999 Holod, Jr.
6,220,992 B1 * 4/2001 Shafik ..... 482/83
6,412,736 B1 * 7/2002 Zaragoza ..... 248/125.8
D474,395 S 5/2003 Mueller
6,604,320 B1 * 8/2003 Hsia ..... 47/47
6,978,974 B1 * 12/2005 Marasco ..... 248/124.1

* cited by examiner

*Primary Examiner*—Amy J. Sterling

(57) ABSTRACT

A Christmas tree support assembly includes a base that includes a pair of legs and a central member that is attached to and extends between the legs. The legs are orientated parallel to each other. A post is attached to and extends upwardly from the central member. A sleeve is attached to an upper end of the post. The sleeve has an opening extending therethrough. The opening has an axis that is orientated parallel to a longitudinal axis of a first of the legs. A rod is positioned in the sleeve and has a proximal end and a distal end with respect to the sleeve. A hook is attached to the rod and extends downwardly from the rod. The hook may be secured to a coupler attached to an upper end of a pine tree.

15 Claims, 4 Drawing Sheets

CHRISTMAS TREE SUPPORT ASSEMBLY

BACKGROUND OF THE INVENTION

1. Field of the Invention

The present invention relates to tree support devices and more particularly pertains to a new tree support device for supporting a pine tree, used for a Christmas decoration, in a vertical orientation and in a stable manner.

2. Description of the Prior Art

The use of tree support devices is known in the prior art. U.S. Pat. No. 5,486,386 describes a Christmas decoration comprising a hanging ornament having the shape of a pine tree that may be hung from a hook attached to a ceiling. Another type of tree support device is U.S. Pat. No. 5,906,869 which again shows a hook assembly that is capable of hanging an artificial Christmas tree from a ceiling. Still another tree support capable of hanging a tree from a ceiling is found in U.S. Pat. No. 5,967,482.

While these devices fulfill their respective, particular objectives and requirements, the need remains for a device that is capable of supporting either a real or artificial tree in a suspended manner so that the tree is vertically orientated and is stable. Preferably the device will also allow rotation of the tree while on the device to assist a person in the positioning of ornaments on the tree.

SUMMARY OF THE INVENTION

The present invention meets the needs presented above by generally comprising a base that includes a pair of legs and a central member that is attached to and extends between the legs. The legs are orientated parallel to each other. A post is attached to and extends upwardly from the central member. A sleeve is attached to an upper end of the post. The sleeve has an opening extending therethrough. The opening has an axis that is orientated parallel to a longitudinal axis of a first of the legs. A rod is positioned in the sleeve and has a proximal end and a distal end with respect to the sleeve. A hook is attached to the rod and extends downwardly from the rod. The hook may be secured to a coupler attached to an upper end of a pine tree.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
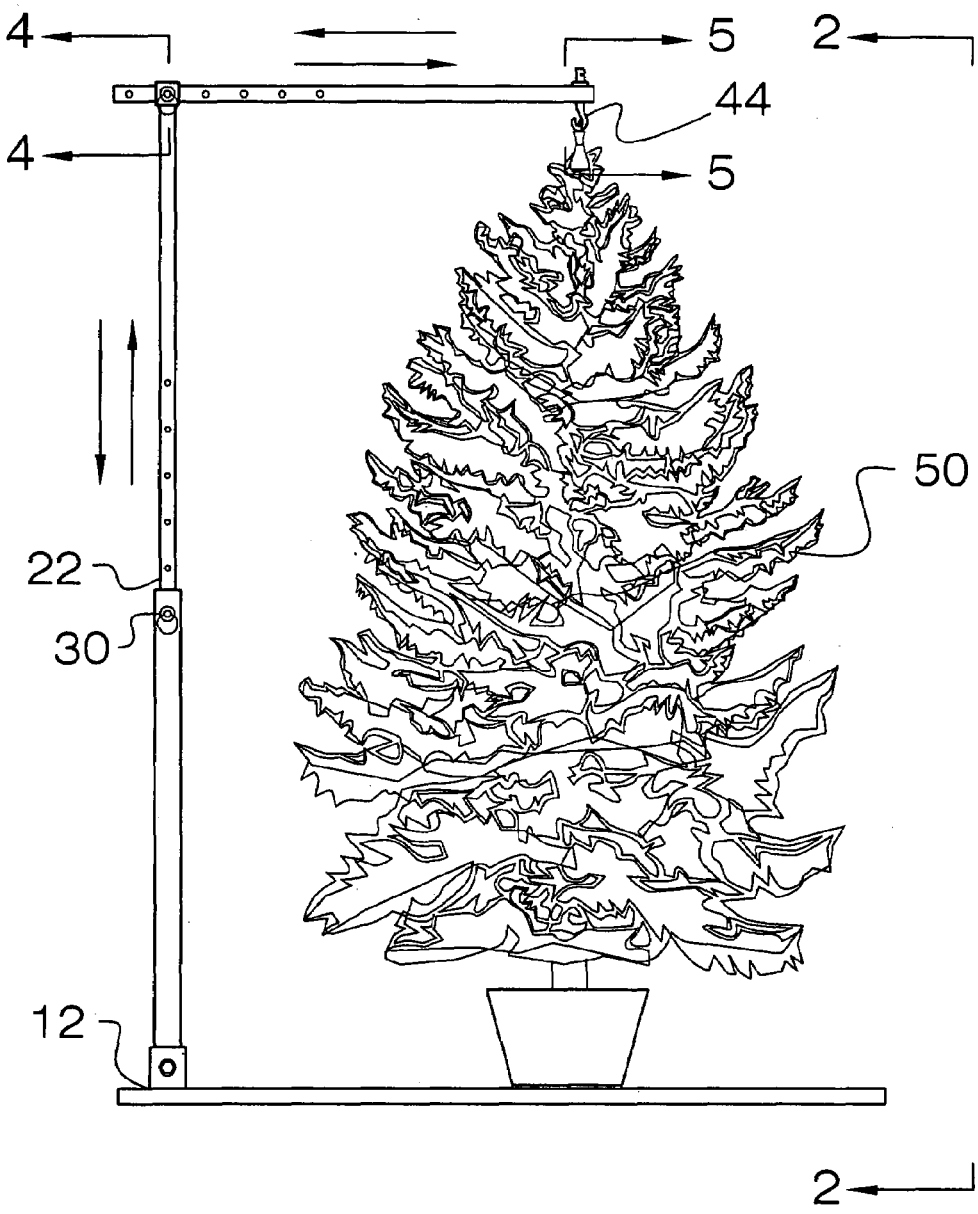
FIG. 1 is a side in-use view of a Christmas tree support assembly according to the present invention.
Figure 2:
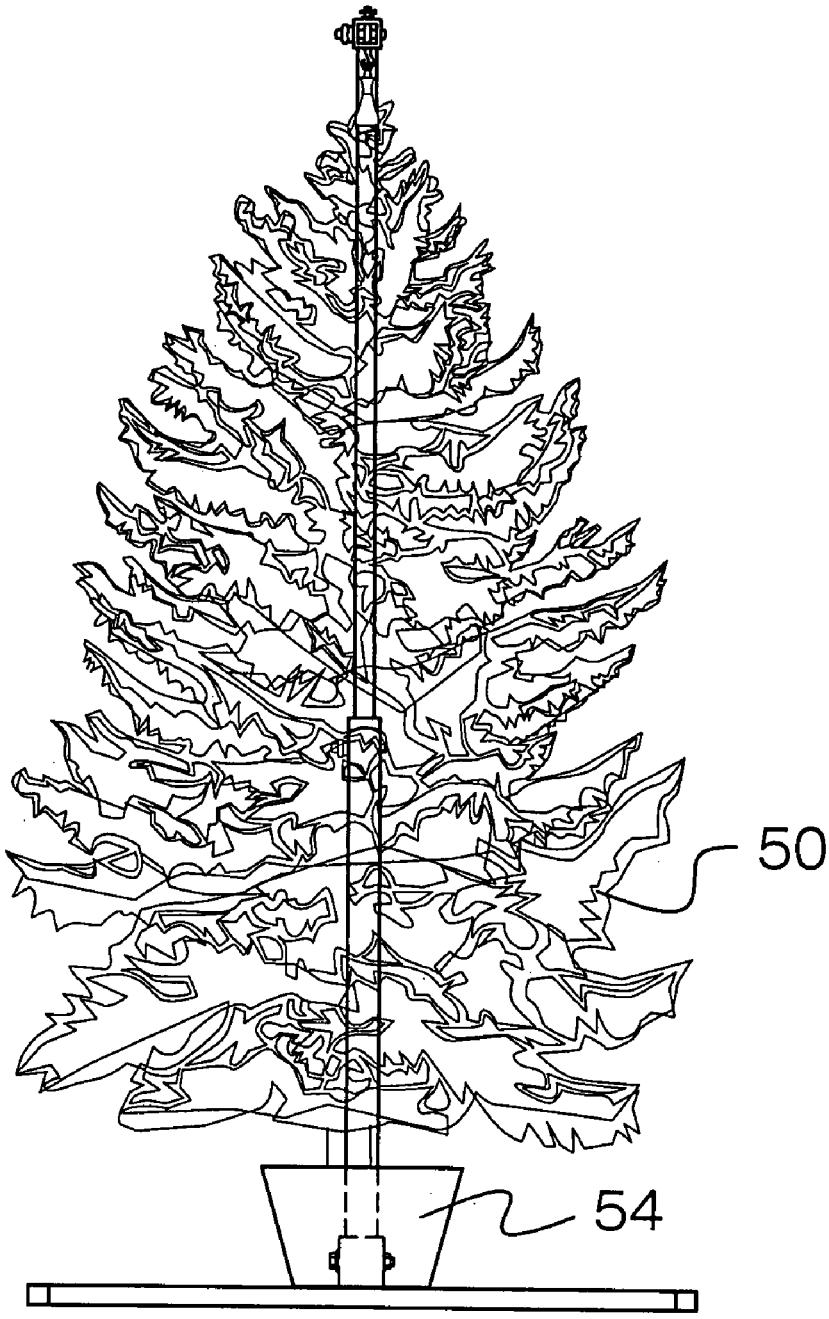
FIG. 2 is a front view of the present invention.
Figure 3:
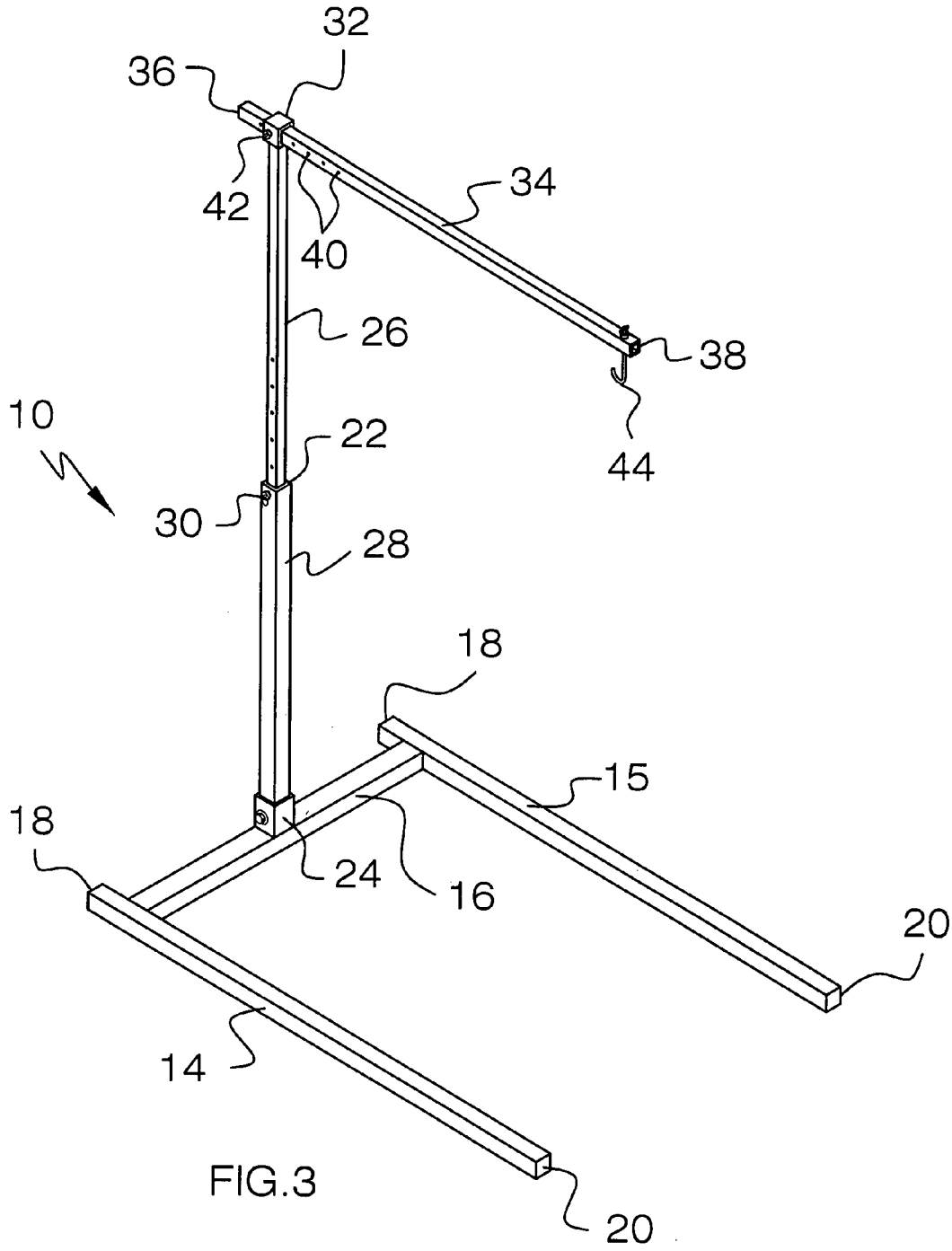
FIG. 3 is a perspective view of the present invention.
Figure 4:
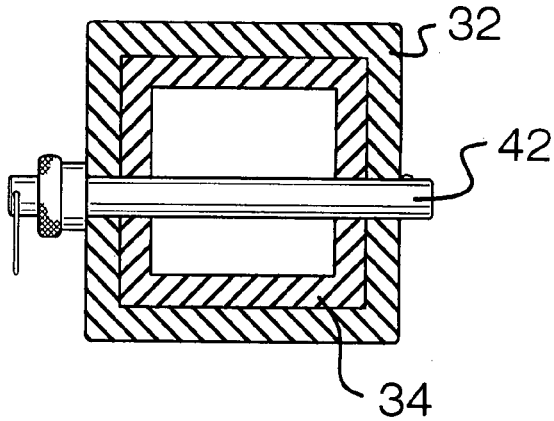
FIG. 4 is a cross-sectional view taken along line 4—4 of FIG. 1 of the present invention.
Figure 5:
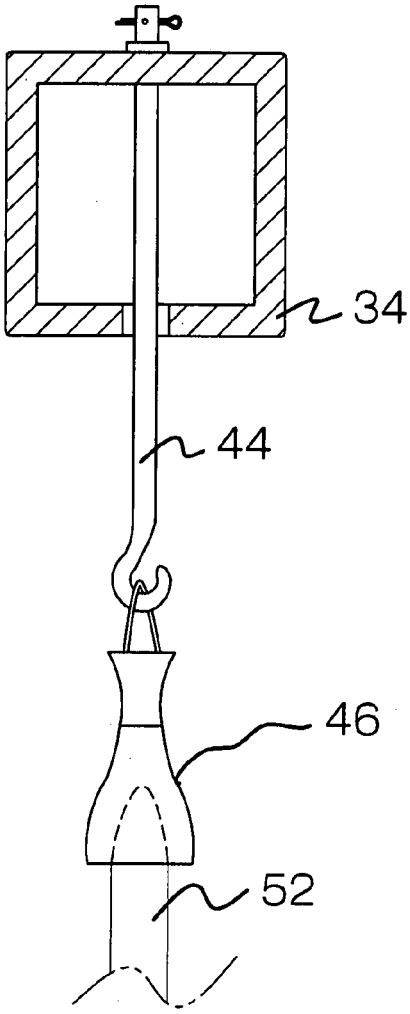
FIG. 5 is a cross-sectional view taken along line 5—5 of FIG. 1 of the present invention.

With reference now to the drawings, and in particular to FIGS. 1 through 5 thereof, a new tree support device embodying the principles and concepts of the present invention and generally designated by the reference numeral 10 will be described.

As best illustrated in FIGS. 1 through 5, the Christmas tree support assembly 10 generally comprises a base 12 that includes a pair of legs 14, 15 and a central member 16 that is attached to and extends between the legs 14, 15. The legs 14, 15 are orientated parallel to each other. Each of the legs 14, 15 has a first end 18 and a second end 20. The central member 16 is positioned adjacent to each of the first ends 18 and orientated perpendicular to each of the legs 14, 15.

A post 22 is attached to and extends upwardly from the central member 16. The post 22 is positioned between the legs 14, 15. The post 22 is telescoping and has a selectable height. The post 22 may be removably attached to the central member 16 by way of a mounting 24 so that the post 22 may be removed from the base 12 when not in use. The post 22 preferably includes an upper section 26 removably extendable into a lower section 28. The upper 26 and lower 28 sections are lockable together at a selected height with a locking pin 30.

A sleeve 32 is attached to an upper end of the post 22. The sleeve 32 has an opening extending therethrough that has an axis that is orientated parallel to a longitudinal axis of a first of the legs 14. A rod 34 is positioned in the sleeve 32. The rod 34 has a proximal end 36 and a distal end 38 with respect to the sleeve 32. The rod 34 has a plurality of aligned apertures 40 therein. The apertures 40 are positioned adjacent to the proximal end 36. A locking pin 42 is removably extendable through the sleeve 32 and through one of the apertures 40. The distal end 36 extends in a same direction as the second ends 20 of the legs 14, 15.

A hook 44 is removably attached to the rod 34 and extends downwardly from the rod 34. The hook 44 is positioned adjacent to the distal end 38 and is rotatable with respect to the rod 34.

In use, the hook 44 may be secured to a coupler 46 attached to an upper end 52 of a pine tree 50. The coupler 46 may include any conventional coupler capable of receiving an upper end 52 of the tree 50. Such couplers 46 may include a line tightening device through which a clothes line is typically extended but into which a branch, or upper end 52, of a pine tree may be extended. The tree 50 is suspended from the rod 34 in a vertical orientation and a bottom end of the tree 50 may be positioned in a container 54 of water. When decorating, an ornament may be positioned over the distal end 38 of the rod 34 to hide the rod 34 and the hook 44.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A Christmas tree support assembly configured for supporting a pine tree in a vertical orientation, said assembly comprising:

a base including a pair of legs and a central member being attached to and extending between said legs, said legs being orientated parallel to each other;

a post being attached to and extending upwardly from said central member;

a sleeve being attached to an upper end of said post, said sleeve having an opening extending therethrough, said opening having an axis orientated parallel to a longitudinal axis of a first of said legs;

a rod being positioned in said sleeve, said rod having a proximal end and a distal end with respect to said sleeve;

a hook being attached to said rod and extending downwardly from said rod; and a coupler receiving an upper end of the tree, said hook being attached to said coupler.

2. The assembly according to claim 1, wherein each of said legs has a first end and a second end, said central member being positioned adjacent to each of said first ends and orientated perpendicular to each of said legs.

3. The assembly according to claim 1, wherein said post is telescoping and having a selectable height.

4. The assembly according to claim 1, wherein said rod has a plurality of aligned apertures therein, said apertures being positioned adjacent to said proximal end, a locking pin being removably extendable through said sleeve and through one of said apertures.

5. The assembly according to claim 1, wherein said hook is positioned adjacent to said distal end.

6. The assembly according to claim 1, wherein said hook is rotatable with respect to said rod.

7. The assembly according to claim 3, wherein said hook is rotatable with respect to said rod.

8. A Christmas tree support assembly configured for supporting a pine tree in a vertical orientation, said assembly comprising:

a base including a pair of legs and a central member being attached to and extending between said legs, said legs being orientated parallel to each other, each of said legs having a first end and a second end, said central member being positioned adjacent to each of said first ends and orientated perpendicular to each of said legs;

a post being attached to and extending upwardly from said central member, said post being positioned between said legs, said post being telescoping and having a selectable height;

a sleeve being attached to an upper end of said post, said sleeve having an opening extending therethrough, said opening having an axis orientated parallel to a longitudinal axis of a first of said legs;

a rod being positioned in said sleeve, said rod having a proximal end and a distal end with respect to said sleeve, said rod having a plurality of aligned apertures therein, said apertures being positioned adjacent to said proximal end, a locking pin being removably extendable through said sleeve and through one of said apertures, said distal end extending in a same direction as said second ends of said legs;

a hook being attached to said rod and extending downwardly from said rod, said hook being positioned adjacent to said distal end, said hook being rotatable with respect to said rod; and a coupler receiving an upper end of the tree, said hook being attached to said coupler.

9. A displaying system comprising:

a pine tree;

a container receiving a bottom end of said tree;

a base including a pair of legs and a central member being attached to and extending between said legs, said legs being orientated parallel to each other;

a post being attached to and extending upwardly from said central member;

a sleeve being attached to an upper end of said post, said sleeve having an opening extending therethrough, said opening having an axis orientated parallel to a longitudinal axis of a first of said legs;

a rod being positioned in said sleeve, said rod having a proximal end and a distal end with respect to said sleeve;

a hook being attached to said rod and extending downwardly from said rod; and a coupler receiving an upper end of the tree pine, said hook being attached to said coupler.

10. The system according to claim 9, wherein each of said legs has a first end and a second end, said central member being positioned adjacent to each of said first ends and orientated perpendicular to each of said legs.

11. The system according to claim 9, wherein said post is telescoping and having a selectable height.

12. The system according to claim 9, wherein said rod has a plurality of aligned apertures therein, said apertures being positioned adjacent to said proximal end, a locking pin being removably extendable through said sleeve and through one of said apertures.

13. The system according to claim 9, wherein said hook is positioned adjacent to said distal end.

14. The system according to claim 9, wherein said hook is rotatable with respect to said rod.

15. The system according to claim 11, wherein said hook is rotatable with respect to said rod.

* * * * *